US009951452B2

(12) United States Patent
Kim

(10) Patent No.: US 9,951,452 B2
(45) Date of Patent: Apr. 24, 2018

(54) DRUM-TYPE WASHING MACHINE

(71) Applicant: Dongbu Daewoo Electronics Corporation, Seoul (KR)

(72) Inventor: In Dong Kim, Seoul (KR)

(73) Assignee: Dongbu Daewoo Electronics Corporation, Seoul (KR)

( * ) Notice: Subject to any disclaimer, the term of this patent is extended or adjusted under 35 U.S.C. 154(b) by 495 days.

(21) Appl. No.: 14/314,522

(22) Filed: Jun. 25, 2014

(65) Prior Publication Data

US 2015/0007395 A1 Jan. 8, 2015

(30) Foreign Application Priority Data

Jul. 4, 2013 (KR) ..... 10-2013-0078299

(51) Int. Cl.
*D06F 37/06* (2006.01)

(52) U.S. Cl.
CPC ..... *D06F 37/065* (2013.01)

(58) Field of Classification Search
CPC ..... D06F 37/06; D06F 37/065
USPC ..... 8/159
See application file for complete search history.

(56) References Cited

U.S. PATENT DOCUMENTS

2005/0252253 A1 11/2005 Ahn

FOREIGN PATENT DOCUMENTS

| | | | | |
|---|---|---|---|---|
| EP | 2039820 A1 * | 3/2009 | ..... | D06F 37/06 |
| GB | 371537 A * | 4/1932 | ..... | D06F 37/065 |
| KR | 10-2005-0047423 A | 5/2005 | | |
| KR | 10-2005-0109400 | 11/2005 | | |
| KR | 10-2006-0115230 A | 11/2006 | | |
| KR | 20060115230 A * | 11/2006 | ..... | D06F 37/06 |
| KR | 101003357 B1 * | 12/2010 | ..... | D06F 37/06 |

OTHER PUBLICATIONS

Abstract for KR 10-2005-0109400; http://engpat.kipris.or.kr; Nov. 21, 2005.

Kim, YoungKi; KIPO; Machine Translation of Foreign Patent Application No.: KR 10-1003357; Samsung Electronics Co., LTD., Applicaton No. 1020030081245; Application Date: Nov. 17, 2003; Published Date Dec. 23, 2010; 5 pages.

* cited by examiner

*Primary Examiner* — Michael E Barr
*Assistant Examiner* — Tinsae B Ayalew

(57) ABSTRACT

Disclosed is a drum type washing machine, including a cabinet configured to form an outer appearance; a tub in the cabinet and configured to contain water therein; a drum in the tub and configured to accommodate laundry therein; and a lifter on the drum, configured to lift the laundry in the drum by upward rotation of the drum. The lifter comprises a lifter housing fixed to the drum and having an opening in one or more ends or sides thereof; and a lifter plate pivotally coupled to the lifter housing, the lifter plate being configured to hold water in the lifter during the upward rotation of the drum.

12 Claims, 15 Drawing Sheets

DRUM-TYPE WASHING MACHINE

CROSS-REFERENCE TO RELATED APPLICATIONS

This application is based on and claims priority to Korean Patent Application No. 10-2013-0078299, filed on Jul. 4, 2013, the disclosure of which is incorporated herein in its entirety by reference.

TECHNICAL FIELD

The present disclosure relates to a drum type washing machine, and more particularly, to a drum type washing machine that is capable of improving washing efficiency with the help of an increased head of wash water by pumping (or lifting) and dropping the wash water using a lifter during the rotation of the drum.

BACKGROUND

A washing machine uses power from an electric motor as main power, and performs washing, rinsing, and drying processes to remove dirt or stains on laundry through the action of detergent and water. The washing machine includes an electric motor, which is a power apparatus, a mechanical part that transfers energy from the motor to the laundry, a controlling part controlling the washing process, a water supply apparatus, and a water draining apparatus.

Washing machines may be classified into agitator type washing machines, pulsator type washing machines, and drum type washing machines, depending on their washing scheme. An agitator type washing machine performs washing by horizontally rotating a wing-shaped agitator in the center of the washing tub, and the pulsator type washing machine performs washing using waves generated by rotating a disk-shaped pulsator. A drum type washing machine includes a drum having a plurality of protrusions formed thereon. The drum type washing machine performs washing using impact generated when the laundry is lifted by a lifter in the drum and then dropped into the wash water and detergent in the drum as a result of rotating the drum around a horizontal axis.

The drum type washing machine performs washing of the laundry by dropping the laundry lifted up by a lifter. However, when the laundry is not lifted up sufficiently, the drum type washing machine suffers from a decreased washing efficiency. Moreover, it is not easy to lift the wash water using the lifter, which may result in less than ideal circulation of the wash water in the drum.

Therefore, there is a need to solve the problems.

SUMMARY

In view of the above, the present disclosure provides a drum type washing machine that is capable of improving the circulation of wash water by pumping (or lifting) and dropping the wash water using a lifter during the rotation of the drum.

Further, the present disclosure provides a drum type washing machine that is capable of improving washing efficiency with the help of an increased head of wash water.

Exemplary embodiments of the present disclosure provide a drum type washing machine, including: a cabinet configured to form an outer appearance (e.g., of the washing machine); a tub in the cabinet and configured to contain water therein; a drum in the tub and configured to accommodate laundry therein; and a lifter on the drum, configured to lift the laundry in the drum by upward rotation of the drum. The lifter comprises: a lifter housing fixed to the drum and having one or more openings in one or more ends or sides; and a lifter plate pivotally coupled to the lifter housing, the lifter plate being configured to hold water in the lifter during the upward rotation of the drum.

Further, the lifter housing may comprise a pair of side walls that face each other with a distance between them. Additionally or alternatively, the lifter housing may be on the inner circumferential surface of the drum and protrude toward a central portion (e.g., the center) of the drum. Also, the lifter housing may comprise a hinge mechanism on a portion of the lifter housing closest to the central portion of the drum that allows the lifter plate to pivot between the side walls, and a free end of the lifter plate may move or rotate along the inner circumferential surface of the drum.

Further, the lifter housing may further comprise stoppers on or near the inner circumferential surface of the drum and in a rotation path of the lifter plate, configured to limit rotation of the lifter plate.

Further, the lifter housing may further comprise impact buffers on the stoppers, configured to buffer the impact of the lifter plate contacting the stoppers.

Further, the lifter housing may further comprise one or more covers on the side walls, configured to enclose one or more ends of the lifter plate.

Further, the lifter plate may have a plurality of projections on its outer surface.

Further, the lifter plate may have a plurality of concave grooves on its outer surfaces.

Further, the lifter plate may comprise a material with an outer surface having a rough texture.

According to exemplary embodiments of the present disclosure, the laundry can be lifted to a position higher than in the prior art, and thus it is possible to achieve an improved washing efficiency due to an increased head of the laundry or impact of the laundry with the water and detergent in the drum.

Further, according to exemplary embodiments of the present disclosure, the water near the bottom of the drum can be lifted up by the lifter, and thus it is possible to achieve improved circulation of the wash water without any additional circulation device.

Further, according to exemplary embodiments of the present disclosure, the wash water is dropped after being lifted to the top of the drum (or at least into the upper half of the drum) by the lifter, and thus it is possible to achieve an improved washing efficiency due to an increased head of the wash water.

BRIEF DESCRIPTION OF THE DRAWINGS

The above and other objects and features of the present invention will become apparent from the following description of various embodiments given in conjunction with the accompanying drawings, in which.

DETAILED DESCRIPTION

Hereinafter, a drum washing machine in accordance with exemplary embodiments of the present disclosure will be described with reference to the accompanying drawings. In the present description, thicknesses of lines, sizes of components, or the like, illustrated in the accompanying drawings may be exaggerated for clarity and convenience of explanation.

Further, the following terms may be defined in consideration of the functions in the present disclosure and may be construed in different ways according to the intention(s) of users and operators. Therefore, the definitions of terms used herein should be construed based on the contents throughout the specification.

Hereinafter, a drum type washing machine in accordance with exemplary embodiments of the present disclosure will be described with reference to FIGS. 1 to 15.

Figure 1:
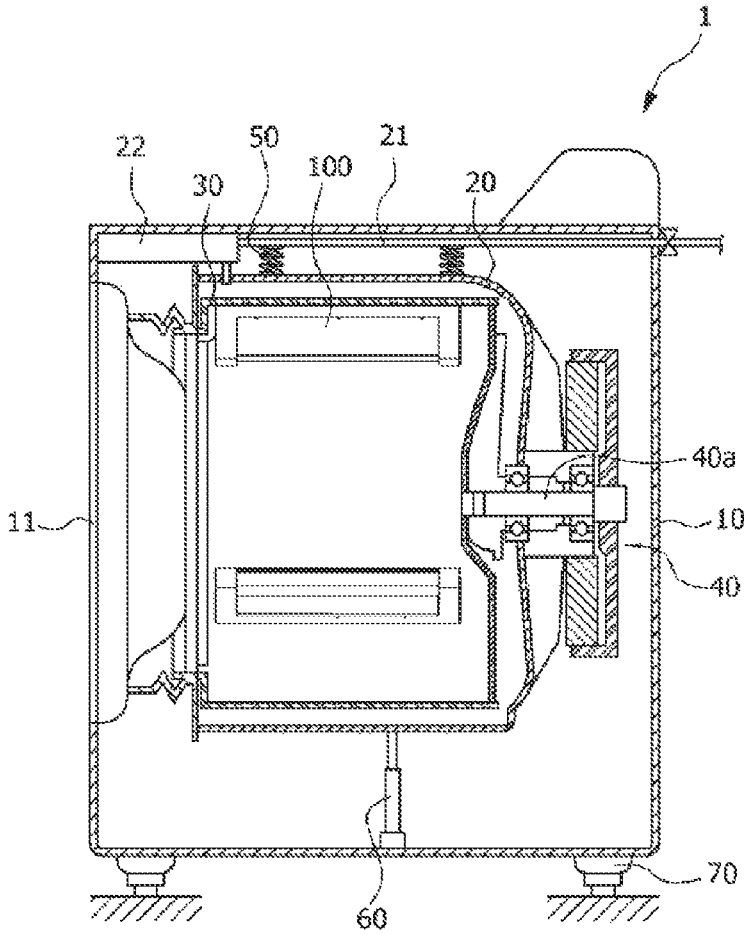
FIG. 1 is a side-sectional view of an exemplary drum type washing machine in accordance with an exemplary embodiment of the present disclosure.
Figure 2:
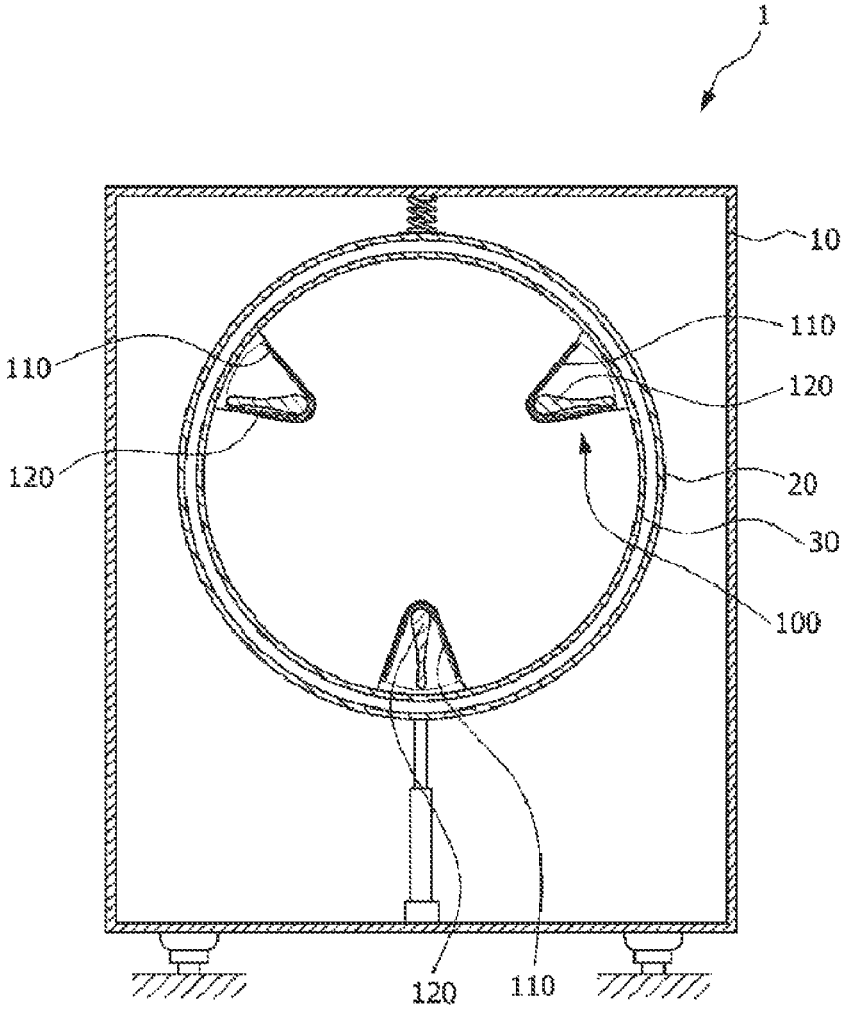
FIG. 2 is a front view of the exemplary drum type washing machine in accordance with an exemplary embodiment of the present disclosure.
Figure 3:
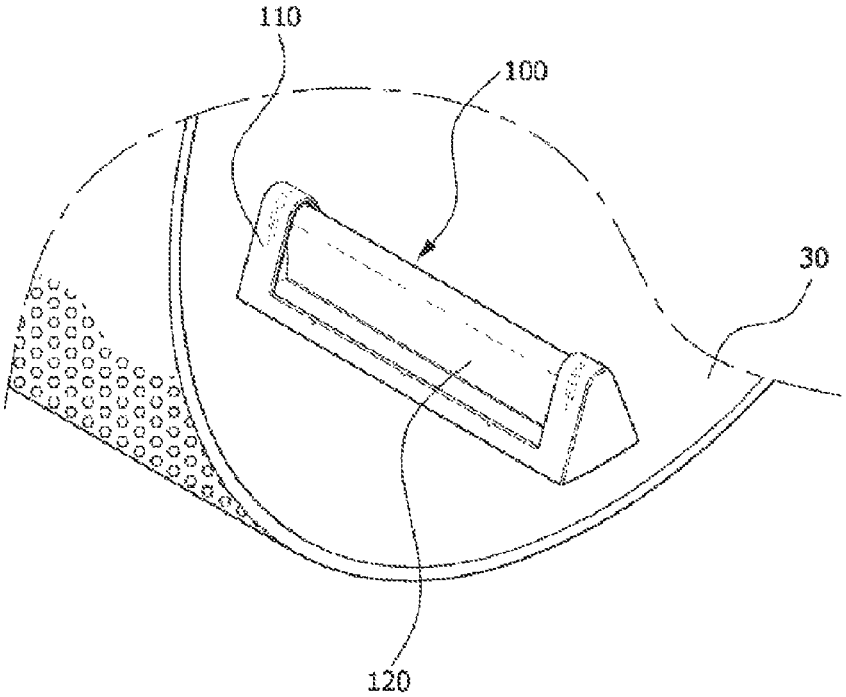
FIG. 3 is an exemplary diagram in which an exemplary lifter is installed in a drum of an exemplary drum type washing machine in accordance with an exemplary embodiment of the present disclosure.
Figure 4:
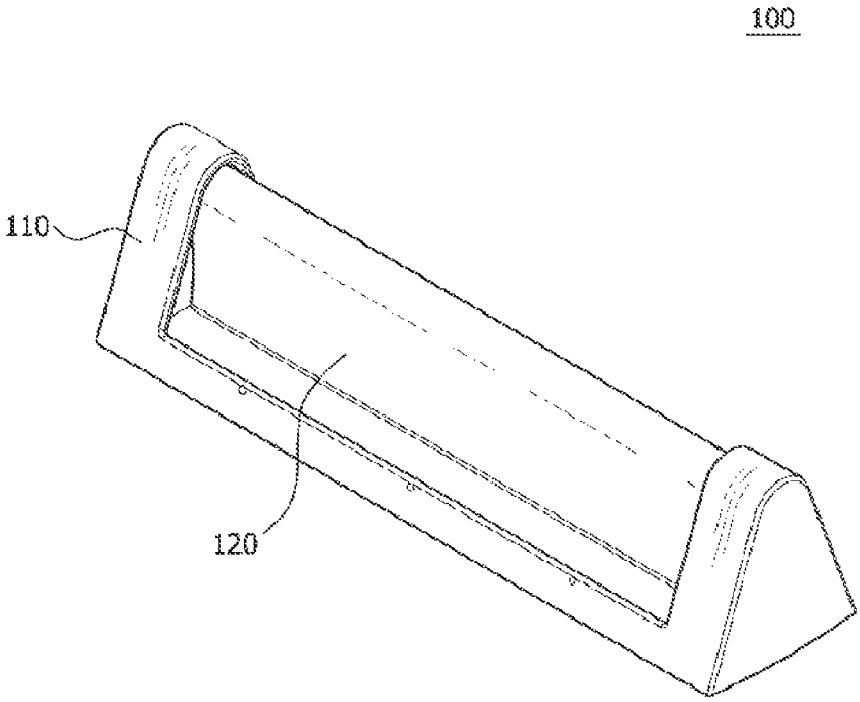
FIG. 4 is a perspective view of the exemplary lifter in accordance with an exemplary embodiment of the present disclosure.
Figure 5:
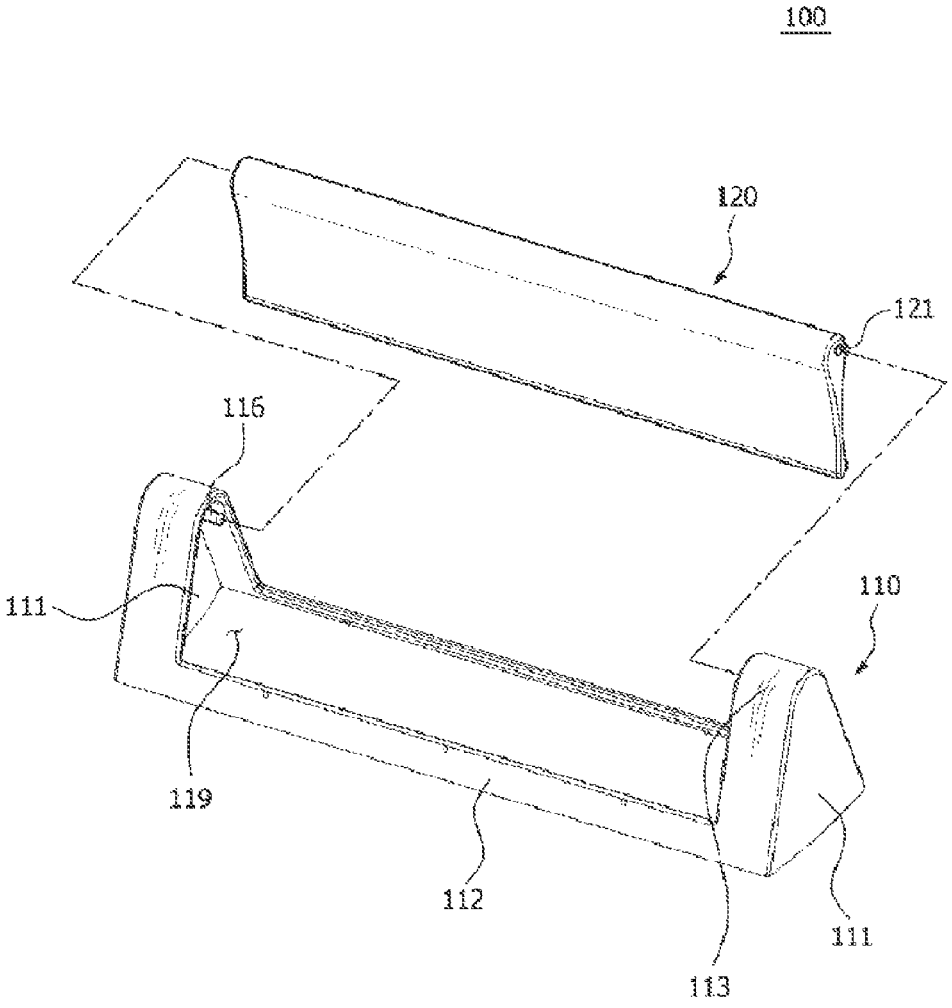
FIG. 5 is an exploded perspective view of the exemplary lifter in accordance with an exemplary embodiment of the present disclosure.
Figure 6:
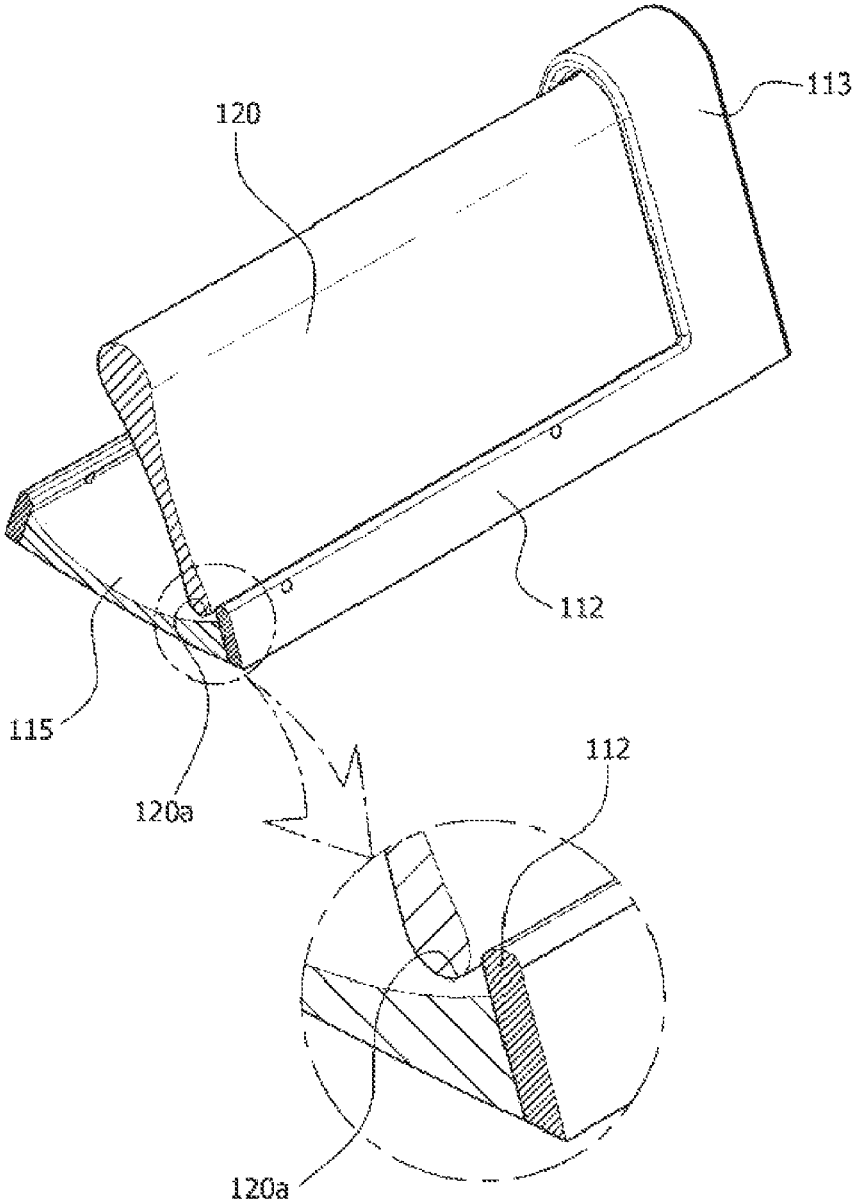
FIG. 6 is a cross-sectional perspective view of an exemplary lifter in accordance with an exemplary embodiment of the present disclosure.
Figure 7:
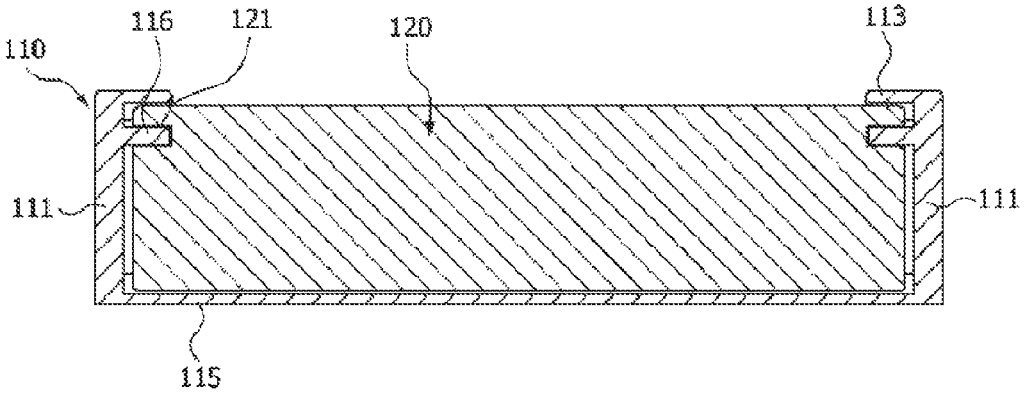
FIG. 7 is a side-sectional view of an exemplary lifter in accordance with an exemplary embodiment of the present disclosure.
Figure 8:
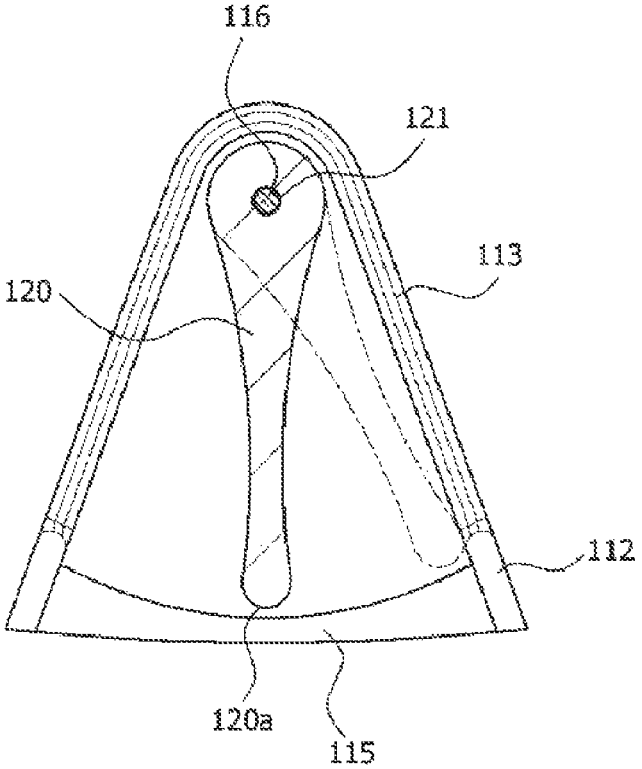
FIG. 8 is a front-sectional view of an exemplary lifter in accordance with an exemplary embodiment of the present disclosure.
Figure 9:
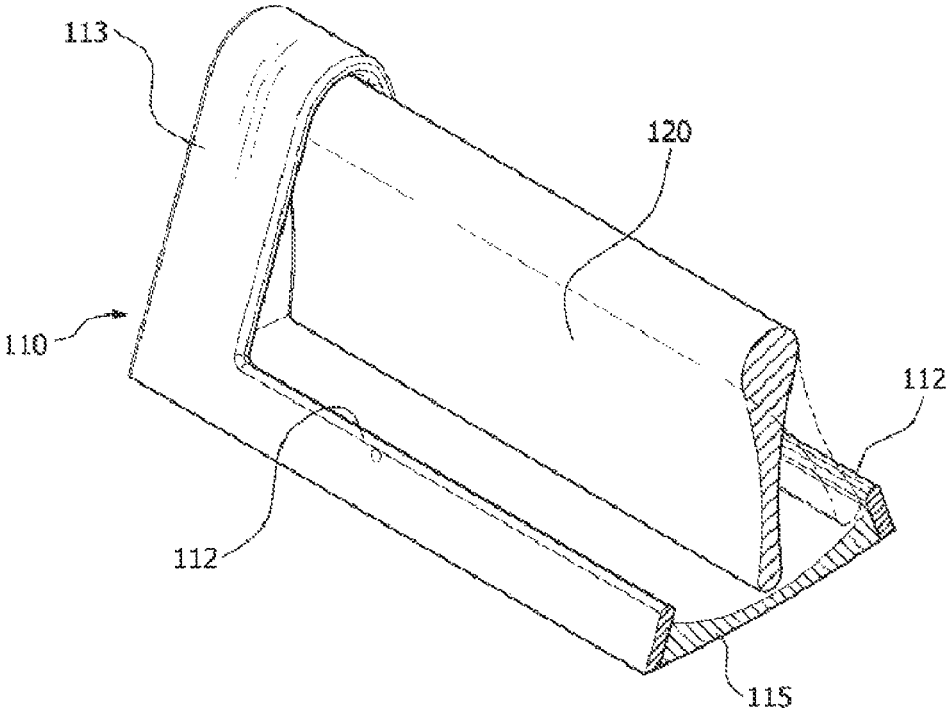
FIG. 9 illustrates an exemplary pivot operation of an exemplary lifter plate in an exemplary lifter in accordance with an exemplary embodiment of the present disclosure.
Figure 10:
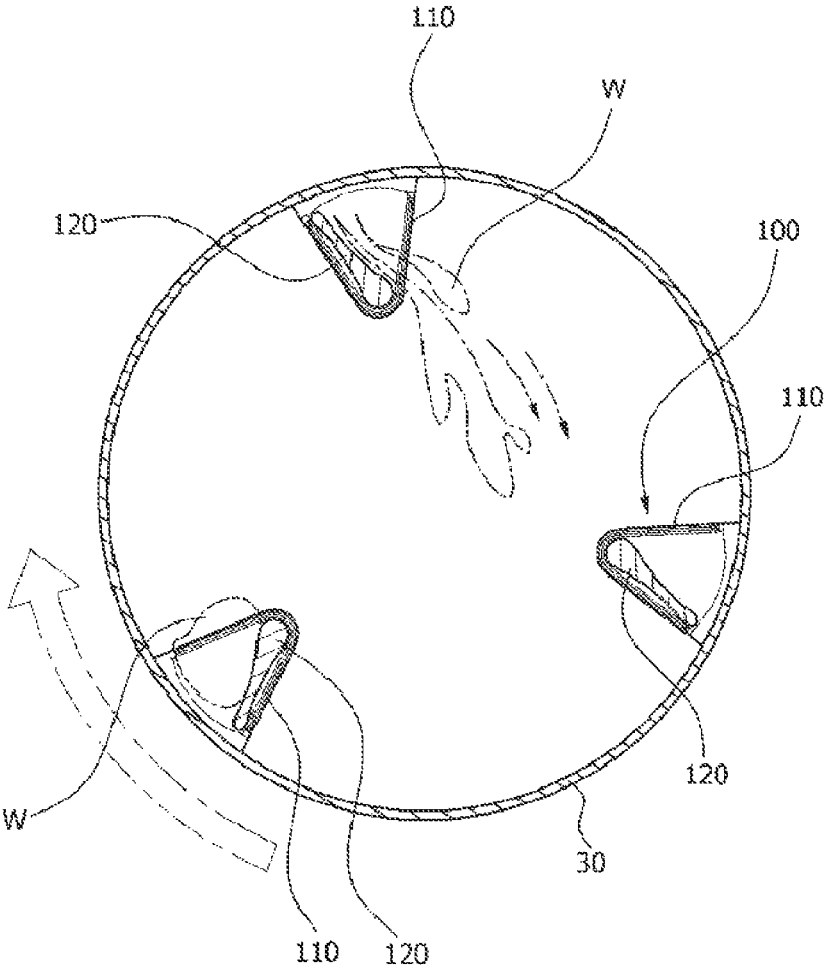
FIG. 10 illustrates an exemplary operation of an exemplary lifter during the clockwise rotation of the drum in an exemplary drum type washing machine in accordance with an exemplary embodiment of the present disclosure.
Figure 11:
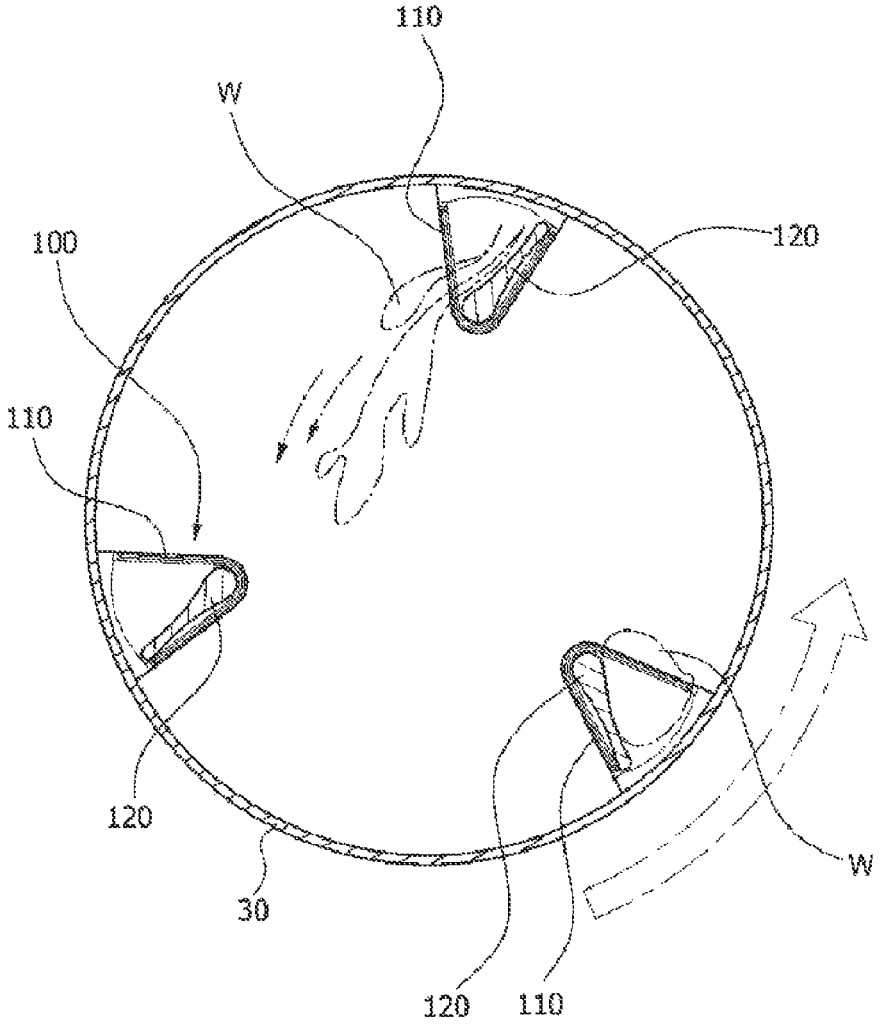
FIG. 11 illustrates an exemplary operation of an exemplary lifter during the counterclockwise rotation of the drum of an exemplary drum type washing machine in accordance with an exemplary embodiment of the present disclosure.
Figure 12:
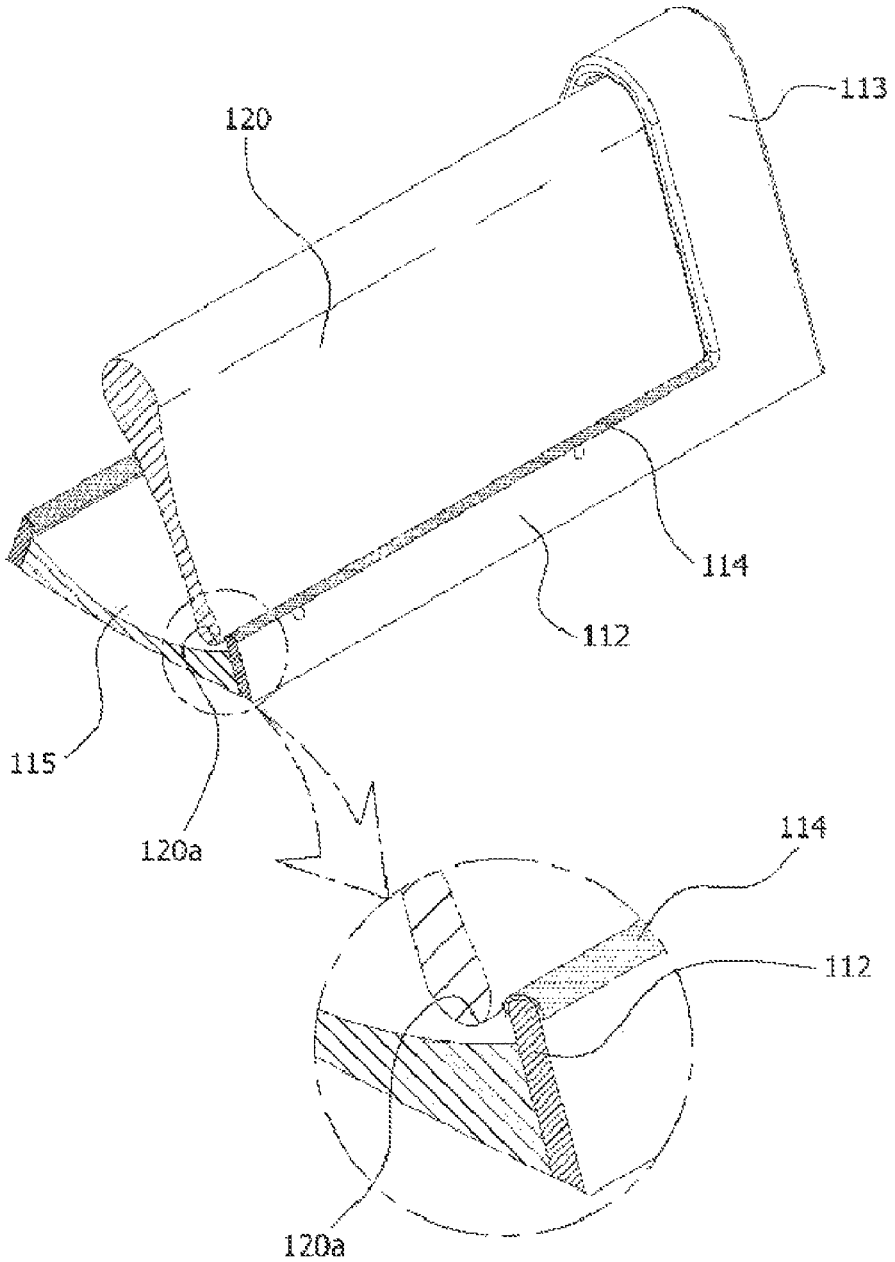
FIG. 12 illustrates an exemplary impact buffer mounted on an exemplary stopper in accordance with an exemplary embodiment of the present disclosure.
Figure 13:
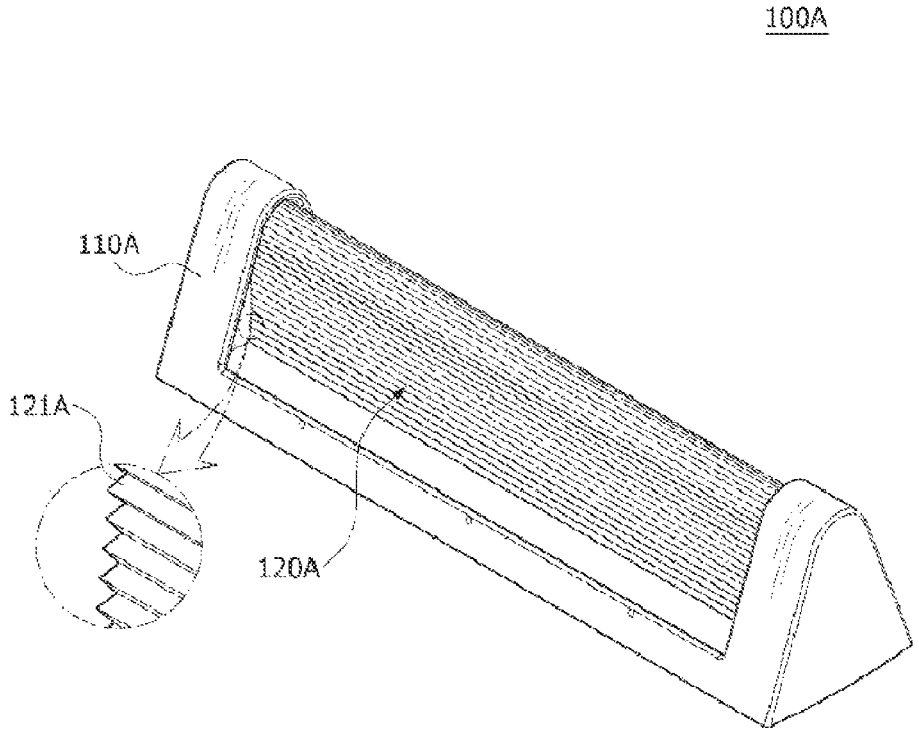
FIG. 13 is a perspective view of a first modified example of an exemplary lifter in accordance with an exemplary embodiment of the present disclosure.
Figure 14:
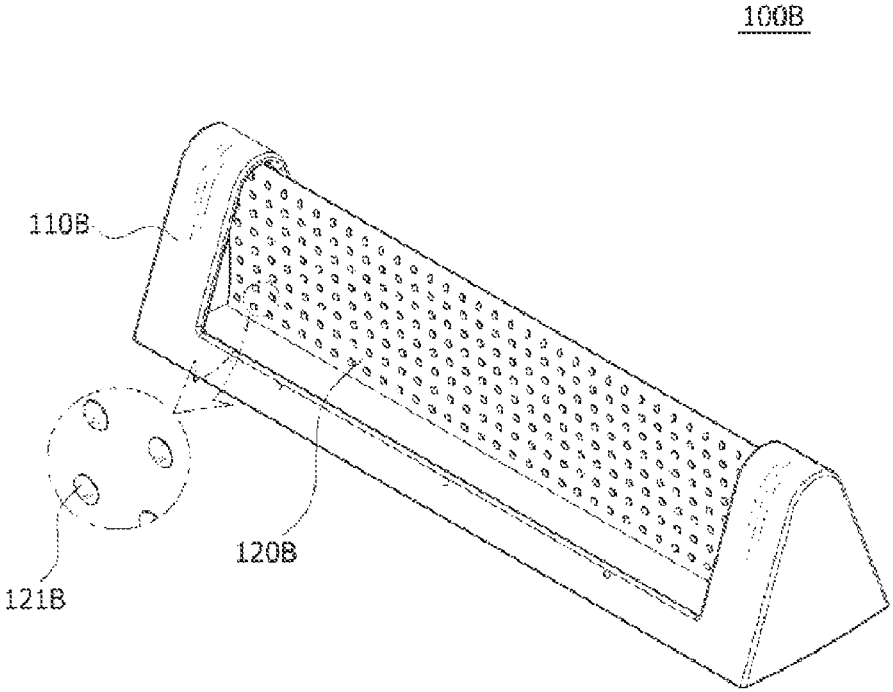
FIG. 14 is a perspective view of a second modified example of an exemplary lifter in accordance with an exemplary embodiment of the present disclosure.
Figure 15:
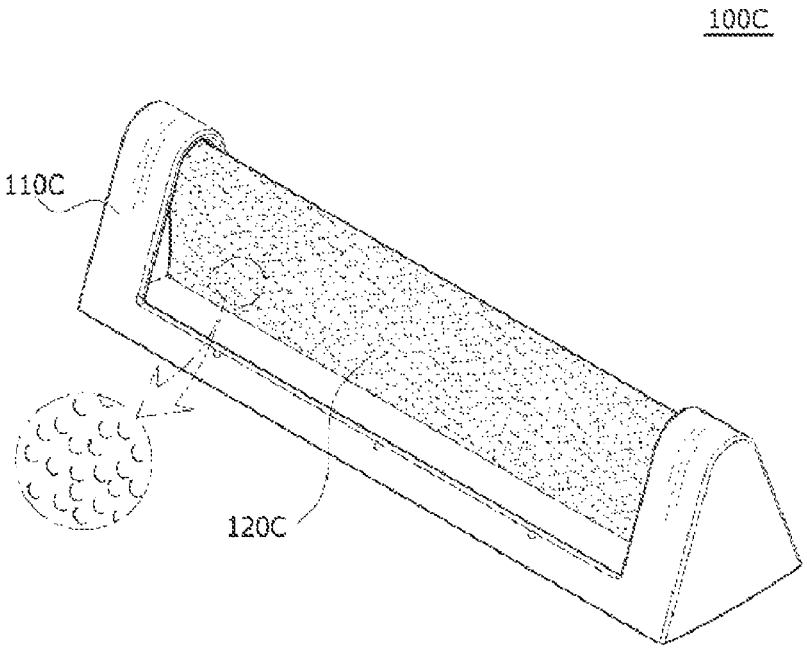
FIG. 15 is a perspective view of a third modified example of an exemplary lifter in accordance with an exemplary embodiment of the present disclosure.

FIG. 1 is a side-sectional view of an exemplary drum type washing machine in accordance with an exemplary embodiment of the present disclosure; FIG. 2 is a front view of the exemplary drum type washing machine in accordance with an exemplary embodiment of the present disclosure; FIG. 3 is an exemplary diagram in which an exemplary lifter is installed in a drum of an exemplary drum type washing machine in accordance with an exemplary embodiment of the present disclosure; FIG. 4 is a perspective view of the exemplary lifter in accordance with an exemplary embodiment of the present disclosure; FIG. 5 is an exploded perspective view of the exemplary lifter in accordance with an exemplary embodiment of the present disclosure; FIG. 6 is a cross-sectional perspective view of an exemplary lifter in accordance with an exemplary embodiment of the present disclosure; FIG. 7 is a side sectional view of an exemplary lifter in accordance with an exemplary embodiment of the present disclosure; FIG. 8 is a front-sectional view of an exemplary lifter in accordance with an exemplary embodiment of the present disclosure; FIG. 9 illustrates an exemplary pivot operation of an exemplary lifter plate in an exemplary lifter in accordance with an exemplary embodiment of the present disclosure; FIG. 10 illustrates an exemplary operation of an exemplary lifter during the clockwise rotation of the drum of an exemplary drum type washing machine in accordance with an exemplary embodiment of the present disclosure; FIG. 11 illustrates an exemplary operation of an exemplary lifter during the counterclockwise rotation of the drum of an exemplary drum type washing machine in accordance with an exemplary embodiment of the present disclosure; FIG. 12 illustrates an exemplary impact buffer mounted on an exemplary stopper in accordance with an exemplary embodiment of the present disclosure; FIG. 13 is a perspective view of a first modified example of an exemplary lifter in accordance with an exemplary embodiment of the present disclosure; FIG. 14 is a perspective view of a second modified example of an exemplary lifter in accordance with an exemplary embodiment of the present disclosure; and FIG. 15 is a perspective view of a third modified example of an exemplary lifter in accordance with an exemplary embodiment of the present disclosure.

As illustrated in FIGS. 1 to 4, an exemplary drum type washing machine 1 includes a cabinet 10 that forms an outer appearance (e.g., housing) of the drum type washing machine 1, a tub 20 disposed between the front and rear plates of the cabinet. 10 that can be partially filled with wash water, a rotatable drum 30 positioned horizontally in the tub 20 and configured to receive laundry therein, a motor 40 that is at a rear wall of the tub 20 to rotate the drum 30, springs 50 that absorb vibrations of the tub 20, a damper 60 that reduces the vibrations of the tub 20, and supporting legs 70 that are at a lower portion of (e.g., under) the cabinet 10 and that support the drum type washing machine 1. Alternatively, the motor 40 may be attached or fixed to an inner surface of the cabinet. 10, and the motor 40 may drive a drive shaft (e.g., 40*a*) attached to the drum 30 using a belt or pulley (not shown).

A front plate of the cabinet 10 is provided with a laundry entrance hole or opening (not shown) through which the laundry is placed or introduced, as well as discharged or removed, and a door 11 that serves to open and close the laundry entrance hole or opening.

The tub 20 has a hollow cylindrical shape that is laid laterally and/or that has a substantially horizontal central axis. The rear of the laundry entrance hole has an opening hole (not illustrated).

An upper portion of the tub 20 (or a space inside the cabinet 10 above the tub 20) includes a water supplying apparatus 21 that supplies water into the tub 20 and a detergent housing 22 that supplies detergent into the tub or drum 30. The tub 20 has the rotatable drum 30 disposed therein.

The drum 30 also has a hollow cylindrical shape that is laterally laid and/or that has a substantially horizontal central axis, similar to the tub 20, and that includes a hole or opening (not illustrated) at the rear of the laundry entrance hole or opening in the tub 20. The drum 30 has a plurality of through holes (not illustrated) in the side (e.g., circumferential) surface thereof, so that the water in the tub 20 may flow thereinto and therefrom. Further, the drum 30 has one or more (e.g., a plurality of lifters 35 on an inner circumferential surface thereof so as to move the laundry.

The motor 40 generates the power and transfers a rotational force generated by a shaft 40*a* connected at the rear of the drum 30 to the drum 30.

The springs 50 absorb the vibrations produced due to the washing process. Each of the springs 50 has one end that is coupled to an upper portion of the tub 20 and another end that is coupled to an upper plate or panel of the cabinet 10. In an exemplary embodiment, at least two springs 60 are provided at each of a front part and rear part of the tub 20 to absorb the vibrations due to horizontal and/or vertical movement of the tub 20.

The damper 60 serves to dampen or reduce the vibrations, along with the springs, due to the vibrations of the tub 20 due to the washing process. The damper 60 has one end that is coupled to a lower portion of the tub 20 and another end that is coupled to a lower plate or panel of the cabinet 10.

Referring to FIGS. 3 to 9 and FIG. 12, the lifters 100 protrude toward a central portion (e.g., the center or horizontal axis) of the drum 30 on an inner circumferential surface of the drum 30. The lifters 100 function to lift the laundry in the drum 30 during the upward rotation of the drum 30.

Each of the lifters 100 includes a lifter housing 110 and a lifter plate 120.

The lifter housing 110 is fixed and/or installed on the internal circumferential surface of the drum 30, and has one or more openings toward the central portion of the drum 30. As the drum 30 rotates, water within the opening 119 stays in the lifter housing 110, and thus water is carried up and lifted upwardly by the lifter plate 120 during the upward rotation of the drum 30.

The lifter housing 110 includes side walls 111, stoppers 112, one or more covers 113, one or more impact buffers 114, a connecting part 115, and shafts 116.

The side walls 111 (e.g., a pair side walls 111) face each other with a distance (e.g., a predetermined or fixed distance) between them on the inner circumferential surface of the drum 30. The side walls 111 protrude or extend toward the central portion (e.g., center) of the drum 30 from the inner circumferential surface of the drum 30. The side walls 111 become narrower in their widths as they become close to or approach the central portion of the drum 30. In this exemplary embodiment, the side walls 111 may have a triangular or substantially triangular shape, and may be flat, planar, or substantially flat or planar.

The stoppers 112 are located in a rotation path of the lifter plate 120 and protrude or extend toward the central portion of the drum from the inner circumferential surface of the drum 30. The lifter plate 120 pivots around the rotation axis of the shafts 116, and the rotation of the lifter plate 120 is limited when it comes in contact with one of the stoppers 112 in the rotation path thereof (see, e.g., FIG. 6).

The lifter plate 120 lifts the wash water within the opening 119 (e.g., in the lifter housing 110) through the limited rotation of the lifter plate 120 by the stoppers 112. In other words, the stoppers 112 function to support the lifter plate 120 while limiting the rotation of the lifter plate 120 so that the lifter plate 120 can hold water (see, e.g., FIG. 10 and FIG. 11).

The stoppers 112 may be disposed in both the clockwise rotation path and the counterclockwise rotation path of the lifter plate 120, so that the rotation of the lifter plate 120 can be limited in both the clockwise and counterclockwise directions. To do it, the stoppers 112 are respectively positioned at the lower ends and/or portions of the side walls 111.

Referring to FIG. 12, one or more impact buffers 114 may be mounted on each of the stoppers 112. The impact buffers 114 buffer the impact generated when the lifter plate 120 comes in contact with a stopper 112. Accordingly, it may be possible to prevent damage to and/or the breakage of the lifter plate 120 and the stoppers 112 caused by the impact of the lifter plate 120 contacting a stopper 112, and/or to reduce the impact noise. Each of the impact buffers 114 may comprise one or more sections along the uppermost edge of the stopper 112, and when the impact buffer(s) 114 comprise a plurality of sections, the sections may be spaced apart from each other by a predetermined distance.

In this exemplary embodiment, the impact buffers 114 may be mounted on and/or surround an end portion or edge of one or more of the stoppers 112, but is not limited thereto. It is understood that the impact buffers may also be mounted in various ways as long as they can buffer the impact from the contact of the lifter plate 120 with the stopper 112. The impact buffers 114 may comprise an elastic material such as a rubber (e.g., a synthetic or natural rubber).

Referring to FIG. 5 to FIG. 7, the cover(s) 113 protrude or extend toward the center of the drum 30, and/or from one side wall 111 toward the opposite side wall 111, so that the ends of the lifter plate 120 hinged to the shafts 116 are respectively enclosed by the cover(s) 113. As a result, a binding or coupling region between the lifter plate 120 and the shafts 116 is not exposed to external forces (e.g., is covered) by the cover(s) 113.

The connecting part 115 is connected or coupled to, or in contact with, the stoppers 112. The stoppers 112 are disposed and/or spaced at a distance (e.g., a predetermined or fixed distance) from each other. In an exemplary embodiment, the connecting part 115 has a circular and/or arc shape to correspond with the shape of the inner circumferential surface of the drum 30 or the rotational path of the lifter plate 120 as it rotates on the shafts 116.

Although the lifter plate 120 is pivotally coupled to the lifter housing 110 by the shafts 116, the cover(s) 113 cover the binding or coupling region between the lifter plate 120 and the shafts 116, so that the laundry can be prevented from being caught in the binding or coupling region between the lifter plate 120 and the shafts 116.

In this exemplary embodiment, the cover(s) 113 may have a V-shaped or substantially V-shaped cross-sectional surface or shape, to correspond with the shape of the side walls 111.

The lifter plate 120 may include holes or openings 121 (e.g., in opposed ends thereof, near an edge nearest to the center of the drum 30) that are hingedly connected to the shafts 116 that are on the side walls 111 (e.g., near a corner or edge nearest to the center of the drum 30), that enables the lifter plate 120 to pivot around a rotation axis of (e.g., defined by a long axis of) the shafts 116. To do it, the lifter plate 120 is provided with shaft holes 121 into which the shafts are inserted. As the shafts 116 are formed in or on the upper portions of the side walls 111 (as viewed in FIG. 5), the unhinged edge or end of the lifter plate 120 moves along the inner circumferential surface of the drum 30 with the upper portions (e.g., the surface or edge nearest to the center of the drum 30) of the side walls ill as the center of rotation.

The lifter plate 120 freely pivots and is limited in its rotation by the contact of the end portion or edge 120*a* of the lifter plate 120 with the stoppers 112 when it reaches the point at which the stoppers 112 are located.

The stoppers 112 support the lifter plate 120 during rotation of the drum 30, while limiting the rotation of the lifter plate 120, so that the wash water within the lifter 100 or the lifter housing 110 can be prevented from spilling out of the lifter 100 and be enclosed by the side walls 111 and the lifter plate 120 during the upward rotation of the drum 30.

Accordingly, the wash water near the bottom of the drum 30 can be lifted upwardly by the lifter 100, and therefore an active circulation of the wash water can be achieved without any separate device for wash water circulation. In other words, the lifter 100 in accordance with the present disclosure helps to circulate the wash water in the drum 30, and thus it is possible to save a cost of installing a separate device for wash water circulation.

Moreover, the lifter 100 not only facilitates the circulation of the wash water, but also lifts up the laundry between the side walls 111 by use of the lifter plate 120. The lifter 100 may lift an amount of the laundry greater than some conventional lifters (e.g., an otherwise identical lifter having solid surfaces, rather than an opening, between the side walls and/or across the face[s] of the lifter).

Since the laundry is lifted up to a higher position, the head of the laundry becomes higher. Therefore, the impact and/or force generated by the collision of the lifted laundry with water and detergent (and/or other objects, such as other laundry) in the drum 30 is also increased after dropping the laundry, which leads to an improved washing efficiency compared to conventional drum type washing machines.

A plurality of lifters 100 may be arranged at identical angular intervals. In an exemplary embodiment, three lifters 100 are arranged 120 degrees apart. However, there may be n lifters (where n is an integer greater than 2), separated by 360/n degrees. The number n may be selected such that 360/n is an integer, and for practical reasons, n may be no greater than 6 or 8. Accordingly, the plural lifters may sequentially deliver more wash water and laundry than that delivered by one lifter using the rotation power of the drum 30. As a result, an improved circulation efficiency of the wash water and an improved washing efficiency of the laundry can be achieved.

FIG. 13 shows a first modified example 100A of the lifter. The lifter 100A is different from the lifter 100 in the shape of the lifter plate (or lifter plate surface) only. The lifter plate of the first modified example has sawtooth-shaped projections (e.g., serrations) 121A at or on its outer surface.

The projections 121A may be from the top to the bottom and/or from end (e.g., nearest the side wall 111) to end of a lifter plate 120A. Alternatively, the projections 121A may be along a portion of the lifter plate 120A that is most likely to contact laundry (e.g., a portion in the center of the lifter plate 120A between side walls 111, and/or nearest the center of the drum 30). The projections 121A on the lifter plate 120A can increase frictional force with the laundry, and can possibly lift more laundry (e.g., due to the increased frictional force with the laundry). With the configuration of the lifter 100A of the first modified example, therefore, the washing effect on the laundry can be further improved.

While the first modified example has been described with regard to sawtooth-shaped projections 121A on the lift plate 210A, the present disclosure is not limited thereto. It is understood that the sawtooth-shaped projections may be substituted with other patterns that provide an increased washing efficiency. Unexplained component reference numeral 110A denotes to a lifter housing.

FIG. 14 illustrates a second modified example 100B of the lifter. The lifter 100B is different from the lifter 100 in the shape of the lifter plate (or the shapes of projections on the surface of the lifter plate) only. The lifter plate 120B of the second modified example has a plurality of concave grooves, wells or depressions 121B on its outer surface, which extend toward the inside of the lifter plate 1206.

The concave grooves, wells or depressions 1216 can be present from the top to the bottom and/or from end (e.g., nearest the side wall 111) to end of the lifter plate 1206. Alternatively, the concave grooves, wells or depressions 121B may be along a portion of the lifter plate 120B that is most likely to contact laundry, as described above. The lifter plate 120B can have an increased friction force with the laundry through the concave grooves, wells or depressions 121B, and thus possibly lift more laundry to a higher location (e.g., than a lifter plate with a smooth surface). Alternatively, the concave grooves, wells or depressions 121B can be replaced with convex, cylindrical, elliptical, square, rectangular, or other shaped projections extending away from the surface of the lifter plate 120B. With the configuration of the lifter 100B of the second modified example, therefore, the washing effect of the laundry can be further improved.

Also, as the wash water is held or accommodated in the concave grooves, wells or depressions 121B, the lifter plate 120B can lift wash water up to the upper side of or the uppermost point in the drum 30 in an amount corresponding to a total volume of the concave grooves, wells or depressions 121B on one surface of the lifter plate 120B. Therefore, a large amount of washing water can be lifted using the second modified example of the lifter 100B.

While the second modified example has been described with regard to the concave grooves, wells or depressions on the lifter plate 120B, the present disclosure is not limited thereto. It is understood that the concave grooves, wells or depressions may be substituted with other patterns that provide an increased friction force with the laundry and/or that lift the washing water. Unexplained component reference numeral 110B denotes a lifter housing.

FIG. 15 illustrates a third modified example 100C of the lifter. The only difference between the lifter 100C and the lifter 100 is the material of the lifter plate (or on the surface of the lifter plate). The lifter plate 120C of the third modified example has an outer surface including a material having a rough texture. The material having a rough texture can be attached or adhered to the surface of the lifter plate, or the lifter plate itself can be made from the rough textured material. Accordingly, the lifter plate 120C has an increased friction force with the laundry without any separate deformation(s) thereof or therein. More laundry can be lifted to a higher position (e.g., than a conventional drum type washing machine with conventional lifters), and therefore, the washing efficiency can be further improved. Unexplained component reference numeral 110C denotes a lifter housing.

Hereinafter, the operation principle of the drum type washing machine in accordance with exemplary embodiments of the present disclosure will be described with reference to FIGS. 10 and 12.

After the laundry is received within the drum 30, an operation panel (not shown) is manipulated to activate the drum type washing machine 1 and/or select a washing process or operation. As the washing process is started, the tub 20 is supplied with water W, which is in turn introduced into the drum 30 via through-holes in the circumferential side thereof.

The drum 30 is rotated by the motor 40, and the laundry in the drum 30 is lifted upward and then dropped downward by the lifters 100 fixed to the inner circumferential surface of the drum 30.

In accordance with exemplary embodiments of the present disclosure, since the opening 119 is in the lifter housing 110 and the lifter plate 120 is supported by the stopper portion 112, the laundry W in the opening 119 (partially or completely) can be lifted upward.

In a case where the drum 30 is rotated clockwise, the laundry is lifted upwardly, as shown in FIG. 10, by the lifters 100, and wash water W is lifted upwardly. Similarly, in a case where the drum 30 is rotated counterclockwise, the laundry is lifted up by the lifters 100, as shown in FIG. 11, and wash water W is lifted upwardly.

As described above, wash water W near the bottom of the drum 30 can be lifted to an upper portion of the drum 30, and therefore, it is possible to actively circulate the wash water in the drum 30 even though a separate device for wash water circulation is not installed. That is, the lifter 100 can help circulate the washing water without any device for wash water circulation, so the cost of a separate device for wash water circulation can be reduced or eliminated.

Further, the active circulation of the wash water is achieved by the lifter 100, and the laundry in the opening 119 is lifted up by the lifter plate 120. Therefore, more laundry can be lifted to a position higher than in a conventional drum type washing machine with a conventional lifter. The increased head of the laundry leads to an improved washing efficiency of the laundry.

Furthermore, as more wash water W is lifted than in a conventional drum type washing machine with a conventional lifter, and to a position higher than the a conventional drum type washing machine with a conventional lifter, the head of the laundry and the impact or force generated by the falling laundry and wash water may be increased, which leads to an improved washing efficiency of the laundry.

Although exemplary embodiments of the present disclosure are described above with reference to the accompanying drawings, those skilled in the art will appreciate that the present disclosure may be implemented in various ways without changing the necessary features or the spirit of the present disclosure.

Therefore, the scope of the present disclosure is expressed by claims below, not the detailed description, and it should be construed that all changes and modifications achieved from the meanings and scope of claims and equivalent concepts are included in the scope of the present disclosure.

What is claimed is:

1. A drum type washing machine, comprising:

a cabinet configured to form an outer appearance;

a tub in the cabinet and configured to contain water therein;

a drum in the tub and configured to accommodate laundry therein; and a lifter on the drum, configured to lift the laundry in the drum by upward rotation of the drum, wherein the lifter comprises:

a lifter housing fixed to the drum and having a space opened toward a central portion of the drum; and a lifter plate having shafts at ends thereof to be pivotally coupled to the lifter housing, the lifter plate being configured to hold and lift water in the space during the upward rotation of the drum, wherein the lifter housing comprises:

a connecting part fixed on an inner circumferential surface of the drum and having short sides extending in a rotational direction of the drum and long sides extending parallel to a rotational axis of the drum;

a pair of side walls coupled to the short sides of the connecting part to face each other with a first distance therebetween, each of the side walls protruding toward the central portion of the drum from the inner circumferential surface of the drum to have a shape becoming narrower in width as each of the side walls approaches the central portion of the drum;

a pair of stoppers coupled to the long sides of the connecting part to face each other with a second distance therebetween; and a pair of covers respectively provided on the side walls to enclose end portions of the lifter plate hinged to the shafts, wherein the stoppers are coupled to lower portions of the covers, and wherein the space opened toward the central portion of the drum is defined by the connecting part, the side walls, the stoppers and the covers.

2. The drum type washing machine of claim 1, wherein the lifter housing is fixed on the inner circumferential surface of the drum and protrudes toward the central portion of the drum.

3. The drum type washing machine of claim 2, wherein the lifter housing comprises a hinge mechanism on a portion of the lifter housing closest to the central portion of the drum that allows the lifter plate to pivot between the side walls.

4. The drum type washing machine of claim 1, wherein the lifter housing further comprises impact buffers on the stoppers, configured to buffer an impact of the lifter plate contacting the stoppers.

5. The drum type washing machine of claim 1, wherein the lifter plate has a plurality of projections extending along an axial direction of a rotational shaft of the lifter plate on its outer surface.

6. The drum type washing machine of claim 1, wherein the lifter plate has a plurality of depressions arranged in a matrix shape on its outer surfaces.

7. The drum type washing machine of claim 1, wherein the lifter plate comprises a material with an outer surface having a rough texture.

8. The drum type washing machine of claim 1, comprising a plurality of the lifter housings, fixed on an inner circumferential surface of the drum and protruding or extending toward the central portion of the drum.

9. A method of operating a drum type washing machine, comprising:

placing laundry in a drum of the drum type washing machine described in claim 1;

adding water to the drum; and rotating the drum.

10. The method of claim 9, comprising a plurality of the lifter housings, fixed on the inner circumferential surface of the drum and protruding or extending toward the central portion of the drum.

11. The method of claim 9, wherein the lifter housing is fixed on an inner circumferential surface of the drum and protrudes or extends toward the central portion of the drum.

12. The method of claim 11, wherein the lifter housing comprises a hinge mechanism on a portion of the lifter housing closest to the central portion of the drum that allows the lifter plate to pivot between the side walls.

* * * * *